US009659432B2

(12) United States Patent
Castro et al.

(10) Patent No.: US 9,659,432 B2
(45) Date of Patent: May 23, 2017

(54) GAMING MACHINE HAVING LIGHT SPLITTING EMOTIVE LIGHTING FEATURE

(71) Applicant: WMS Gaming Inc., Waukegan, IL (US)

(72) Inventors: Christian L. Castro, Chicago, IL (US); Robert J. Glenn, II, Chicago, IL (US); Timothy C. Loose, Chicago, IL (US); Bruce E. Reid, Lake Zurich, IL (US); Wingate K. Williams, Algonquin, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 350 days.

(21) Appl. No.: 14/312,806

(22) Filed: Jun. 24, 2014

(65) Prior Publication Data

US 2015/0371486 A1 Dec. 24, 2015

(51) Int. Cl.
*G07F 17/32* (2006.01)

(52) U.S. Cl.
CPC ..... *G07F 17/3211* (2013.01)

(58) Field of Classification Search
USPC ..... 463/31
See application file for complete search history.

(56) References Cited

U.S. PATENT DOCUMENTS

| | | | | |
|---|---|---|---|---|
| 6,695,703 | B1 | 2/2004 | McGahn | 463/46 |
| 6,945,685 | B1 | 9/2005 | Sokolov | 362/632 |
| 7,048,631 | B2 | 5/2006 | Goins | 463/31 |
| 7,682,249 | B2 | 3/2010 | Winans | 463/31 |
| 8,002,424 | B2 | 8/2011 | Hwang | 362/125 |
| 8,128,483 | B2 | 3/2012 | Vann | 463/20 |
| 8,235,813 | B2 | 8/2012 | Cornell | 463/31 |
| 8,303,420 | B2 | 11/2012 | Chudek | 463/46 |
| 8,376,839 | B2 * | 2/2013 | Lesley | G07F 17/32 345/44 |
| 8,777,757 | B2 * | 7/2014 | Chudek | G07F 17/3202 463/46 |
| 2005/0261057 | A1 | 11/2005 | Bleich | 463/30 |

(Continued)

FOREIGN PATENT DOCUMENTS

| | | | |
|---|---|---|---|
| WO | WO 01/35017 A1 | 5/2001 | F21V 11/00 |
| WO | WO 2004/075128 A1 | 9/2004 | G07F 17/32 |
| WO | WO 2006/036486 A1 | 4/2006 | G07F 17/3216 |

*Primary Examiner* — Pierre E Elisca
(74) *Attorney, Agent, or Firm* — Marc D. Thompson

(57) ABSTRACT

A gaming system includes at least one light pipe which splits, reflects, and propagates light provided from one or more internal light sources to a plurality of external regions of the gaming system. The light sources may include sets of LEDs which deliver light via multiple light pipes or differing sections of the same light pipe, in varying configurations. Each light pipe may utilize a light splitter-reflector to receive, split, direct, propagate, and emit light from one or more sections of internally positioned light sources, simultaneously projecting decorative lighting to multiple exterior surfaces and regions of the gaming system. Light pipe assemblies may be constructed from modular pieces which include a separate light splitter-reflector, or from a single piece of uniform material which splits, directs, and emits light. Variations of direct light, indirect (reflected) light, and combinations of both enable various lighting patterns on the exterior of gaming machines.

30 Claims, 10 Drawing Sheets

(56) References Cited

U.S. PATENT DOCUMENTS

| | | | | |
|---|---|---|---|---|
| 2012/0129601 | A1 | 5/2012 | Gronkowski | 463/31 |
| 2012/0178528 | A1 | 7/2012 | Brunell | 463/31 |
| 2014/0087887 | A1 | 3/2014 | Chudek | 463/46 |

* cited by examiner

GAMING MACHINE HAVING LIGHT SPLITTING EMOTIVE LIGHTING FEATURE

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to an emotive lighting feature for lighting a gaming machine implementing a light splitting component.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

Traditionally, gaming machines operate under control of a processor that has been programmed to execute base games and bonus games in which reel arrays spin and stop to display symbol combinations in a display area. If winning combinations are achieved by the symbol combinations, awards are provided to the players.

SUMMARY OF THE INVENTION

According to one aspect of the present invention, a gaming system comprises a cabinet, a display device, one or more light sources, and a light pipe structure. The cabinet includes a cabinet frame facing a player position in front of the gaming machine. The display device is positioned within the cabinet and is configured to display a wagering game. The light pipe structure is positioned along the cabinet frame and includes a dividing reflector and first and second arms extending from the dividing reflector. The dividing reflector is positioned and configured to receive light projected by the one or more light sources, directing a first portion of the light through the first arm, and directing a second portion of the light through the second arm.

According to another aspect of the invention, a lighting arrangement for a gaming machine is disclosed. The gaming machine includes a cabinet and a display device. The cabinet includes a cabinet frame facing a player position in front of the gaming machine. The display device is positioned within the cabinet and is configured to display a wagering game. The lighting arrangement includes one or more light sources and a light pipe structure. The light pipe structure is positioned along the cabinet frame and includes a dividing reflector and first and second arms extending from the dividing reflector. The dividing reflector is positioned and configured to receive light projected by the one or more light sources. The dividing reflector serves to direct a first portion of the light through the first arm and direct a second portion of the light through the second arm.

According to another aspect of the invention, a method of operating a gaming machine is disclosed. The gaming machine includes a cabinet, a display device, and a light pipe structure. The cabinet includes a cabinet frame facing a player position in front of the gaming machine. The display device is positioned within the cabinet and is configured to display a wagering game. The light pipe structure is positioned along the cabinet frame and includes a dividing reflector and first and second arms extending from the dividing reflector. The method includes projecting light from one or more light sources onto the dividing reflector. The dividing reflector then directs a first portion of the light through the first arm and a second portion of the light through the second arm.

According to another aspect of the invention, a gaming machine is disclosed. The gaming machine includes a cabinet having a cabinet frame, one or more light sources, one or more display devices within the cabinet frame displaying a wagering game, and at least one light pipe. The cabinet frame is facing a player position in front of the gaming machine. The one or more light sources are providing light, internally positioned, and are not viewable from the player position. The at least one light pipe includes a light splitter-reflector positioned to provide a first portion of the light to a first emitting surface via a first pipe section, and a second portion of the light to a second emitting surface via a second pipe section.

According to another aspect of the invention, a method of implementing one or more lighting sources to illuminate a plurality of non-overlapping regions of a gaming machine is disclosed. The method includes providing an initial light from at least one of the one or more lighting sources. The initial light is then split and reflected to a plurality of light pipes. A portion of the initial light is received at each of the plurality of light pipes. Light is propagated by each of the plurality of light pipes to illuminate non-overlapping regions of the gaming machine visible to the player of the gaming machine.

According to still another aspect of the invention, the above gaming system is incorporated into a single, free-standing gaming terminal.

Additional aspects of the invention will be apparent to those of ordinary skill in the art in view of the detailed description of various embodiments, which is made with reference to the drawings, a brief description of which is provided below.

Figure 1:
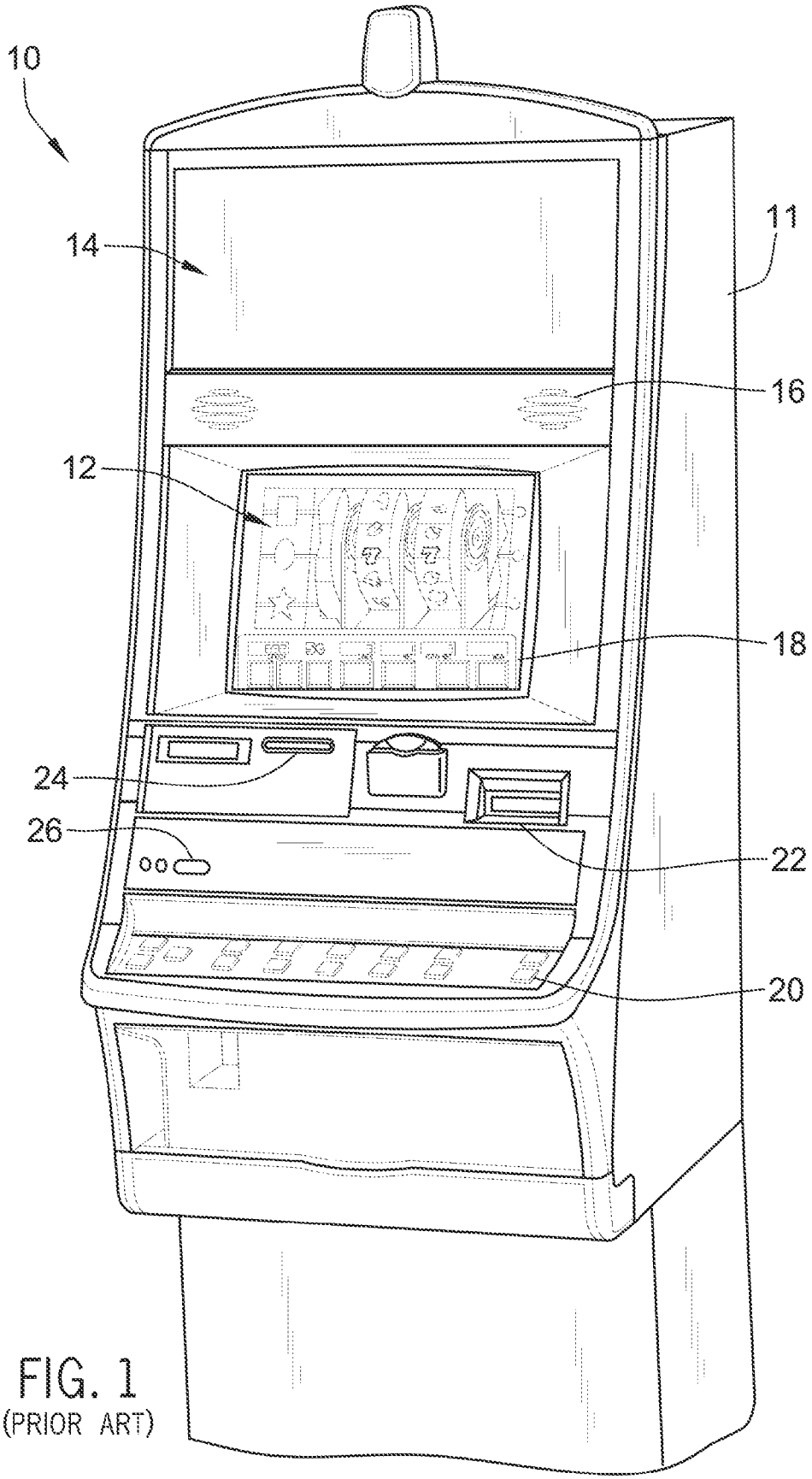
FIG. 1 (PRIOR ART)
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those used in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in conducting wagering games, or may include non-dedicated devices, such as mobile phones, personal digital assistants, personal computers, etc. Exemplary types of gaming machines are disclosed in U.S. Pat. No. 6,517,433, U.S. Pat. No. 8,057,303, and U.S. Pat. No. 8,226,459, which are incorporated herein by reference in their entireties.

The gaming machine 10 illustrated in FIG. 1 comprises a cabinet 11 that may house various input devices, output devices, and input/output devices. By way of example, the gaming machine 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

Input devices, such as the touch screen 18, buttons 20, a mouse, a joystick, a gesture-sensing device, a voice-recognition device, and a virtual-input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a game-logic circuitry for processing. The electronic data signals are selected from a group consisting essentially of an electrical current, an electrical voltage, an electrical charge, an optical signal, an optical element, a magnetic signal, and a magnetic element.

Figure 2:
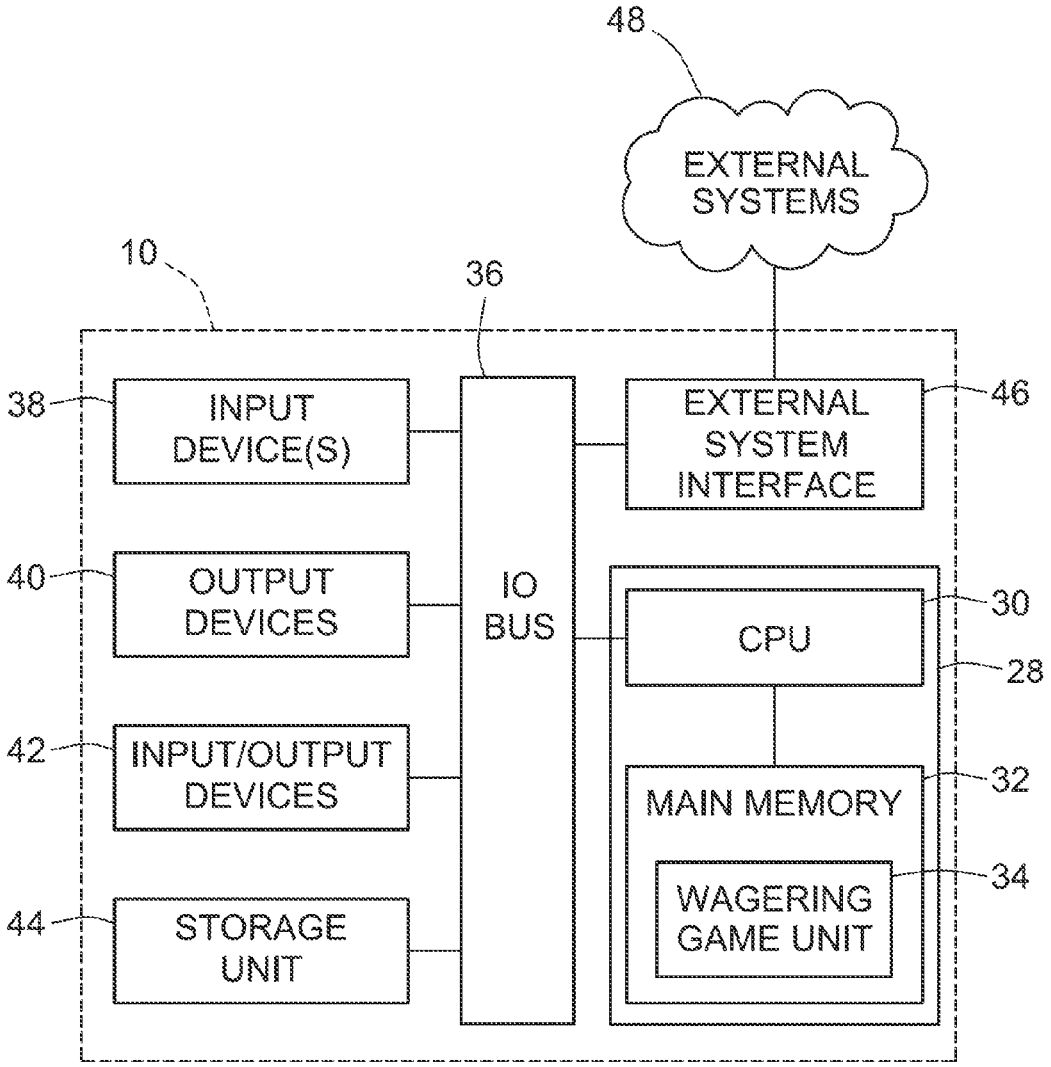
FIG. 2 (PRIOR ART)
FIG. 2 is a schematic view of a gaming system according to an embodiment of the present invention.

Turning now to FIG. 2, there is shown a block diagram of the gaming-machine architecture. The gaming machine 10 includes game-logic circuitry 28 having a central processing unit (CPU) 30 connected to a main memory 32. The CPU 30 may include any suitable processor(s), such as those made by Intel and AMD. By way of example, the CPU 30 may include a plurality of microprocessors including a master processor, a slave processor, and a secondary or parallel processor. Game-logic circuitry 28, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 28, and more specifically the CPU 30, comprises one or more controllers or processors and such one or more controllers or processors need not be disposed proximal to one another and may be located in different devices or in different locations. The game-logic circuitry 28, and more specifically the main memory 32, comprises one or more memory devices which need not be disposed proximal to one another and may be located in different devices or in different locations. The game-logic circuitry 28 is operable to execute all of the various gaming methods and other processes disclosed herein. The main memory 32 includes a wagering-game unit 34. In one embodiment, the wagering-game unit 34 may cause wagering games to be presented, such as video poker, video black jack, video slots, video lottery, etc., in whole or part.

The game-logic circuitry 28 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to a storage unit 44 and an external-system interface 46, which may be connected to external system(s) 48 (e.g., wagering-game networks).

The external system 48 includes, in various aspects, a gaming network, other gaming machines or terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external-system interface 46 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 48 such that the gaming machine 10 operates as a thin, thick, or intermediate client. The game-logic circuitry 28—whether located within ("thick client"), external to ("thin client"), or distributed both within and external to ("intermediate client") the gaming machine 10—is utilized to provide a wagering game on the gaming machine 10. In general, the main memory 32 (comprising one or more memory devices) stores programming for an RNG, game-outcome logic, and game assets (e.g., art, sound, etc.). When a wagering-game instance is executed, the CPU 30 (comprising one or more processors or controllers) executes the RNG programming to generate one or more pseudo-random numbers. The pseudo-random numbers are utilized by the CPU 30 when executing the game-outcome logic to determine a resultant outcome for that instance of the wagering game. The resultant outcome is then presented to a player of the gaming machine 10 by accessing the associated game assets, required for the resultant outcome, from the main memory 32. The CPU 30 causes the game assets to be presented to the player as outputs from the gaming machine 10 (e.g., audio and video presentations).

The gaming machine 10 may include additional peripheral devices or more than one of each component shown in FIG. 2. Any component of the gaming-machine architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
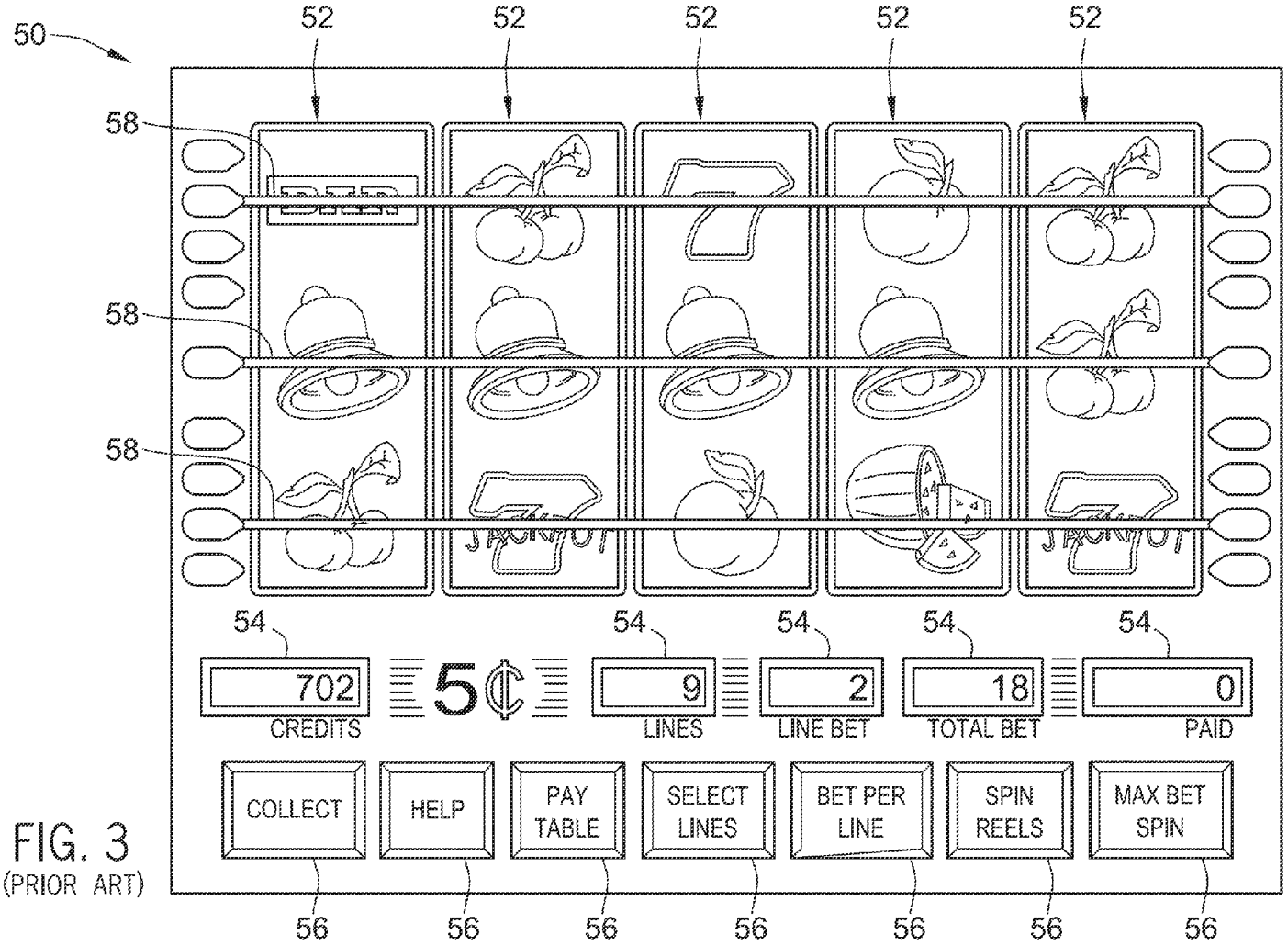
FIG. 3 (PRIOR ART)
FIG. 3 is an image of an exemplary basic-game screen of a wagering game displayed on a gaming machine, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The game-logic circuitry 28 operates to execute a wagering-game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 12 or secondary display 14) through the display of information such as, but not limited to, text, graphics, static images, moving images, etc., or any combination thereof. In accord with the method of conducting the wagering game, the game-logic circuitry 28 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 28 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 30 causes the recording of a digital representation of the wager in one or more storage media (e.g., storage unit 44), the CPU 30, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU 30 (e.g., the wager in the present example). As another example, the CPU 30 further, in accord with the execution of the stored instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 28 to determine the outcome of the wagering-game instance. In at least some aspects, the game-logic circuitry is configured to determine an outcome of the wagering-game instance at least partially in response to the random parameter.

Figure 4A:
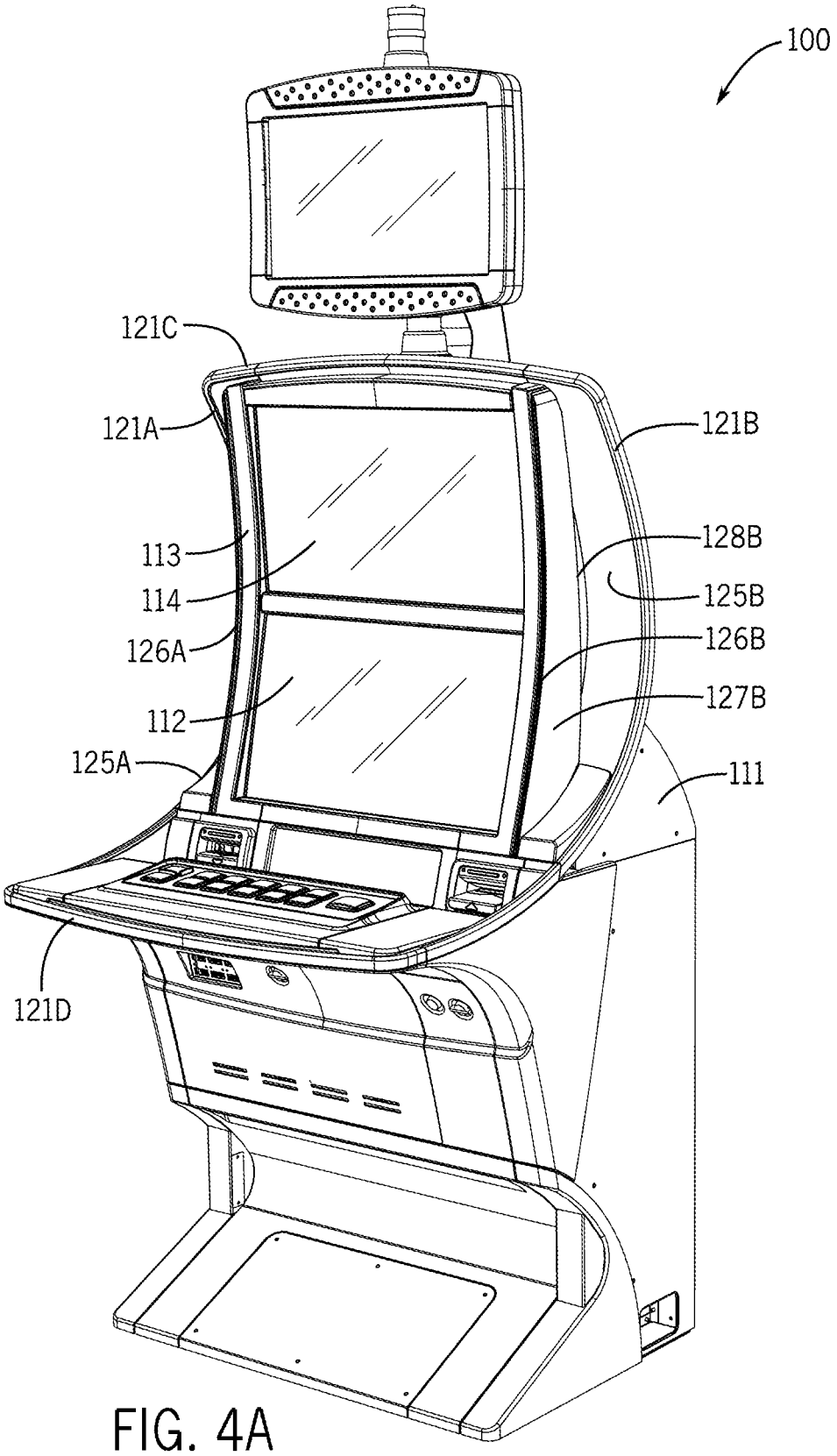
FIG. 4A is an image of a gaming system implementing a light splitting emotive lighting feature according to an embodiment of the present invention.

Referring now to FIG. 4A, a gaming machine 100 has a cabinet 111 that may house various input devices, output devices, and input/output devices. The gaming machine 100 is similar, but not identical, to the gaming terminal 10 illustrated in FIG. 1. The gaming machine 100 includes a primary display area 112 and a secondary display area 114, each of which being a mechanical-reel display, a video display, or a combination thereof in which a transmissive video display is disposed in front of the mechanical-reel display to portray a video image superimposed upon the mechanical-reel display.

The cabinet 111 has a cabinet frame 113 facing a player position in front of the gaming machine 100. The primary and secondary display areas 112, 114 are positioned within the cabinet frame 113 and are configured to display a wagering game to the player position. For example, the primary display area 112 is configured to show a basic-game screen that may be similar to the basic-game screen 50 described in reference to FIG. 3. The secondary display area 114 is configured to show a similar image and/or other images. The primary display area 112 is located below the secondary display area 114 and angled towards the player position. The secondary display area 114 is generally positioned in a vertical orientation parallel to the player position.

The display portion of the cabinet frame 113 is defined by a plurality of exterior edges, including a left exterior edge 121A, a right exterior edge 121B, an upper exterior edge 121C, and a lower exterior edge 121D. In this embodiment, the left and right exterior edges 121A, 121B merge above the display areas 112, 114 to form upper exterior edge 121C, and curve inwardly to form lower exterior edge 121D.

The right and left sides of the display portion of the cabinet frame 113 of gaming machine 100 include recessed curved portions 125A and 125B, front light pipe exposure zones 126A and 126B, light pipe covers including 127A (not shown) and 127B, and rear light pipe exposure zones 128A (not shown) and 128B. Each side of the gaming machine 100 has a pair of light pipe exposure zones consisting of a front light pipe exposure zone (e.g., 126B) and a rear light pipe exposure zone (e.g., 128B) which are opposite faces of the same light pipe (e.g., light pipe 140). The majority of the light pipe is shielded from view by a light pipe cover (e.g., 127B). The recessed curved portions 125A, 125B of the gaming machine 100 are generally reflective, and serve to redirect light being projected to them to the player position and surroundings of the gaming machine 100. Details of the light pipe 140 which are shielded from view in this figure will be discussed later in reference to FIG. 5A-5B.

Details of the overall operation and configuration of singular light pipe elements, generation of primary and secondary zones of light using a single light pipe, and optical physics of light sources and singular light pipe usage may be reviewed in U.S. patent application Ser. No. 13/627,560, filed Sep. 26, 2012, now U.S. Pat. No. 8,777,757 B2, titled "Gaming machine having enhanced emotive lighting feature," which is incorporated herein in its entirety.

The front light pipe exposure zones 126A, 126B are designed to be directly viewable from the player position and form a contour of bright light at the sides of the display areas 112, 114. Additional light pipes may be used to outline the entirety of the display areas 112, 114 (and their respective edges), as well as other areas including a button panel and the base of gaming machine 100 to provide an enhanced gaming experience for the player. For example, an additional dual edge light pipe may be installed in the machine in FIG. 4A below the lower exterior edge 121D, to provide a front light pipe exposure zone directed at the player position and a rear light pipe exposure zone directed at a reflective surface below the button panel.

The rear light pipe exposure zones 128A, 128B are also designed to be viewable from the player position, but in a very different manner. In one embodiment, similar to the front light pipe exposure zones 126A, 126B, the rear light pipe exposure zones 128A, 128B extend vertically along the sides of the display areas 112, 114 generating zones of washed light upon recessed curved portions 125. This is performed by the rear light pipe exposure zones 128A, 128B projecting light exiting from the light pipe 140 directly at the recessed curved portions 125 of the gaming machine 100. This light is reflected by the recessed curved portions 125A, 125B, becoming visible to the player position. The recessed curved portions 125A, 125B are contoured so as to reflect light to the player position and the surroundings of the gaming machine 100 in this manner.

The shape of the recessed curved portions 125A, 125B are highly variable and provide a wide spectrum of differing patterns and washed lighting effects resulting from the reflection of the light projected from set of rear light pipe exposure zones 128A, 128B. In contrast to the bright light provided by the front light pipe exposure zones 126A, 128B, the rear light pipe exposure zones 128A, 128B form a contour of washed, dimmed light from behind the display areas 112, 114. As such, there is a visual contrast between the bright light of the front light pipe exposure zones 126A, 126B and the rear light pipe exposure zones 128A, 128B further enhance the gaming experience for the player. Alternatively, combinations of bright and washed light may be provided which enable a wide variety of decorative effects.

In other embodiments, the gaming machine 100 may include other configurations of light zones. For example, in an alternative configuration, the front light pipe exposure zones 126A, 126B and the rear light pipe exposure zones 128A, 128B are projected to a reflective or semi-reflective surface causing various washed lighting effects. This provides the capability for the front light pipe exposure zones 126A, 126B to be less bright than the rear light pipe exposure zones 128A, 128B, for example, by modifying the reflective nature of the recessed curved portions 125 and the angle of light exiting from the front light pipe exposure zones 126A, 126B to an accompanying adjacent washed lighting surface. Further, additional zones of light may be provided parallel to the existing zones of light 126A, 126B, 128A, and 128B. In yet other examples, the exposure zones 126A, 126B, 128A, and 128B can be configured to extend in part or wholly between the top exterior edge 121C and the lower exterior edge 121D, as well as the left and right exterior edges 121A, 121B.

For ease of understanding, reference will be made to a generalized discussion of front and rear light pipe exposure zones 126A, 126B, 128A, and 128B, and primary (direct) and secondary (indirect) zones of light generated by portions of the present invention as depicted in FIG. 4A. However, it is understood that the description is applicable to any arrangement, alignment, directionality of lighting elements, and other configuration of accompanying light zones without departing from the spirit and scope of the invention.

The front light pipe exposure zones 126A, 126B are directly facing the player position in front of the gaming machine 100 and are fully viewable from that perspective. Furthermore, the front light pipe exposure zones 126A, 126B are viewable from the player position as generally vertical edges. It is noted that it is also possible for a set of front light pipe exposure zones to be installed horizontally to be viewable from the player position as generally horizontal edges without departing or detracting from the spirit and scope of the invention.

The rear light pipe exposure zones 128A, 128B may not be generally viewable from the player position in front of the gaming machine 100; rear light pipe exposure zones 128A, 128B face away from player position. However, each of the rear light pipe exposure zones 128A, 128B may be viewable from the appropriate side of gaming machine 100, and may appear as a vertical edge from this particular viewpoint. Similar to the front light pipe exposure zones 126A, 126B, it is possible for the rear light pipes exposure zones 128A, 128B to be installed horizontally without departing from the spirit and scope of the invention. In one embodiment, the rear light pipe exposure zones 128A, 128B are positioned such that a large amount of projected light emanating therefrom is directed at the set of recessed curved portions 125A, 125B which reflect projected light from the rear light pipe exposure zones 128A, 128B, providing a much softer light than light emanating directly from the light pipe material (e.g., front light pipe exposure zones 126A, 126B). The recessed curved portions 125A, 125B are positioned to be viewable from the player position in front of the gaming machine 100 and are positioned to direct much of the reflected light from rear light pipe exposure zones 128A, 128B to the player position and surrounding area. This configuration provides a washed, softer lighting effect comprising a less direct, less concentrated shower of light than the emanating directly from the light pipe edge.

Depending upon positioning in a particular embodiment, both the front and rear light pipe exposure zones 126A, 126B, 128A, and 128B each provide multiple distinct zones of light. These zones may include a zone of primary light (i.e., direct light), a zone of secondary light, (i.e., indirect light), and a combination of the two. A zone of primary light is created by light which exits a light pipe exposure zone and does not reflect off another surface prior to entering a viewer's eye. Thus, a zone of primary light may be more direct and relatively bright when compared to reflected light. A zone of secondary light may be created by light which exits a light pipe and reflects off one or more surfaces to provide a softer, less intense type of light projection. Thus, a zone of secondary light is indirect and considerably dimmer when compared to a zone of primary light generated from the same light source. Zones of secondary light are sometimes called "washed" light, "diffused" light, or light "fill", depending upon how the zones of light are produced.

A reflective surface used on the recessed curved portions 125A, 125B may include a chrome material providing diffusing effects on light received and reflected towards the player position. Optionally, the chrome material may be textured to include a pattern or background indicia. For example, a manufacturer trademark and/or brand (e.g., "WMS") or a Casino-specific logo can be included in the textured pattern or indicia. The recessed curved portions 125A, 125B may be contoured such that they have a concave curvature relative to surface of the rear light pipe exposure zone 128A, 128B. The concave curvature and/or the chrome material are helpful in achieving a gentle glow of light, with a gentle gradation of light, for the secondary light zone generated upon the recessed curved portions 125A, 125B.

Each of the light pipe exposure zones 126A, 126B, 128A, and 128B provide zones of both primary and secondary light, often not equally, depending on where the viewer is positioned and the particulars of the light pipe configuration. For example, in the current embodiment displayed in FIGS. 4A and 4B, the front light pipe exposure zones 126A, 126B, provide a strong, direct source of light (i.e., a zone of primary light) and the recessed curved portions 125A, 125B produce washed light from the light projected from the rear light pipe exposure zones 128A, 128B and reflect at least some of the washed light as indirect light (i.e., a zone of secondary light) when viewed from the player position. These differing zones of light each emit a distinct type of light pattern for enhancing the visual experience of the player.

Thus, in one embodiment, the gaming machine 100 includes a right and left side, having a front and back section, wherein each section is generating and projecting light. As viewable from the player position, the primary zones of light emanating from the front light pipe exposure zones 126A, 126B provide strong, bright light regions which are contrasted by the secondary zones of light emanating from the rear light pipe exposure zones 128A, 128B reflected by recessed curved portions 125A, 125B. Further, the rear light pipe exposure zones 128A, 128B expose a varying amount of indirect light to different areas of the recessed curved portions 125A, 125B creating a smooth transition from the bright rear light pipe exposure zones 128A, 128B to the recessed curved portions 125A, 125B of the gaming machine 100. As such, the visual contrast between the bright light of the primary zones and the dimmed light of the secondary zones, particularly as light is projected from the rear light pipe exposure zones 128A, 128B further enhance the visual and gaming experience for the player.

Optionally, in other examples, the gaming machine 100 may include other configurations of light zones. For example, in one alternative configuration the rear light pipe exposure zones 128 are positioned to project primary zones of light to the player position while the front light pipe exposure zones 126 are positioned to be hidden from the player position and reflect light to inside or outside surface (s) to create secondary light zones. The brightness or comparative dimness of various zones of light may also be altered in a number of ways (discussed later) to further provide a variety of combinations of lighting zones which provide a myriad of suitable and aesthetically pleasing configurations. Further, light pipe edges (and adjoining surfaces) may be configured in a number of ways to provide primary and/or secondary light zones to further enhance visual appeal. The design, material, color, reflectiveness, etc., of the recessed curved portions 125A, 125B are also variable and contribute to the aesthetics of gaming machine 100. All of these configurations are within the spirit and scope of the invention as disclosed, and no one configuration should be held as specifically limiting.

Figure 4B:
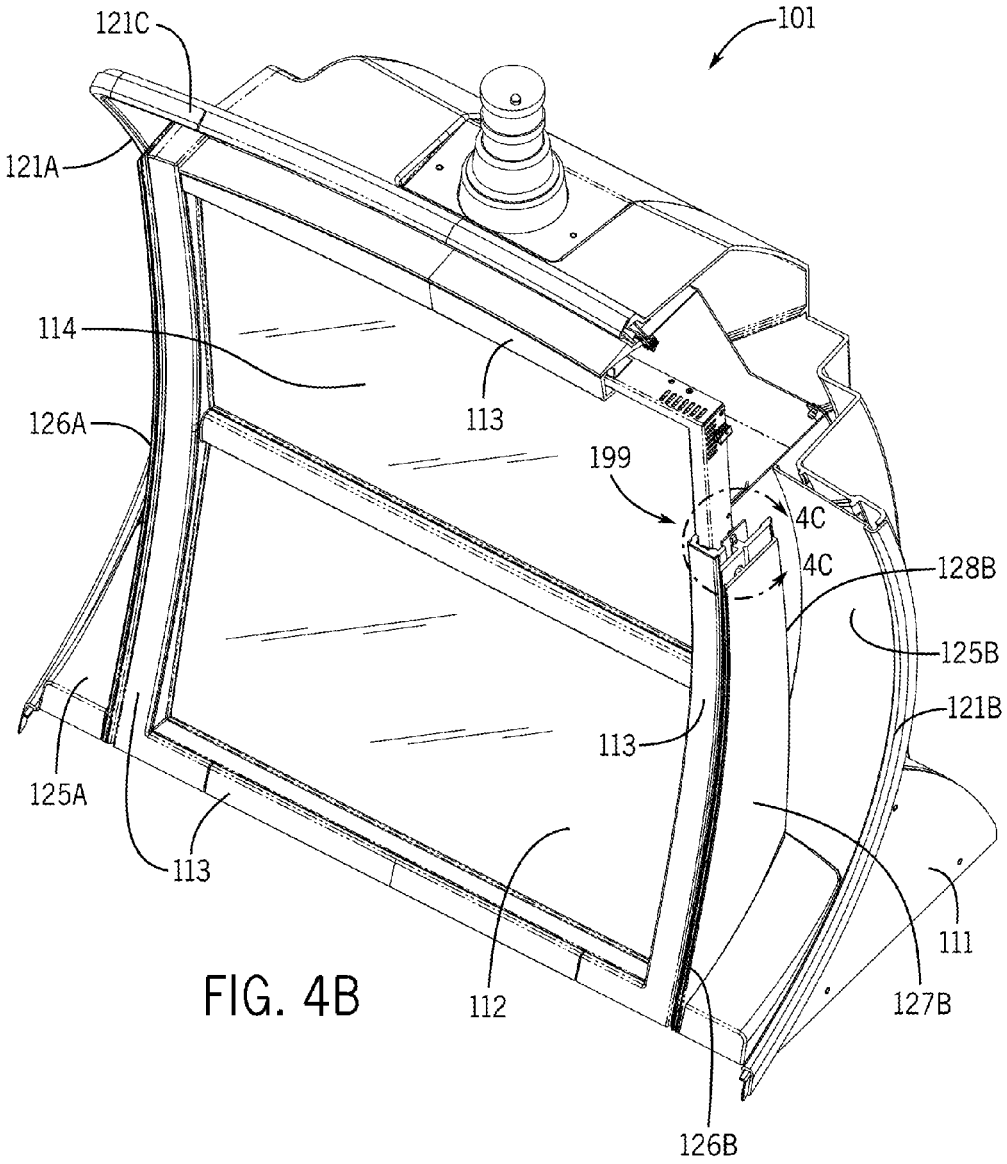
FIG. 4B is an image of the upper section of a gaming system implementing a light splitting emotive lighting feature having an exposed section according to an embodiment of the present invention.

Referring to FIG. 4B, an upper section is shown of a gaming machine 101 which is similar, but not identical, to gaming machine 100 in FIG. 4A. A section of the gaming cabinet on the upper right side as viewed from the player position is removed, revealing internal components of the gaming machine 101 in an exposed view 199.

Figure 4C:
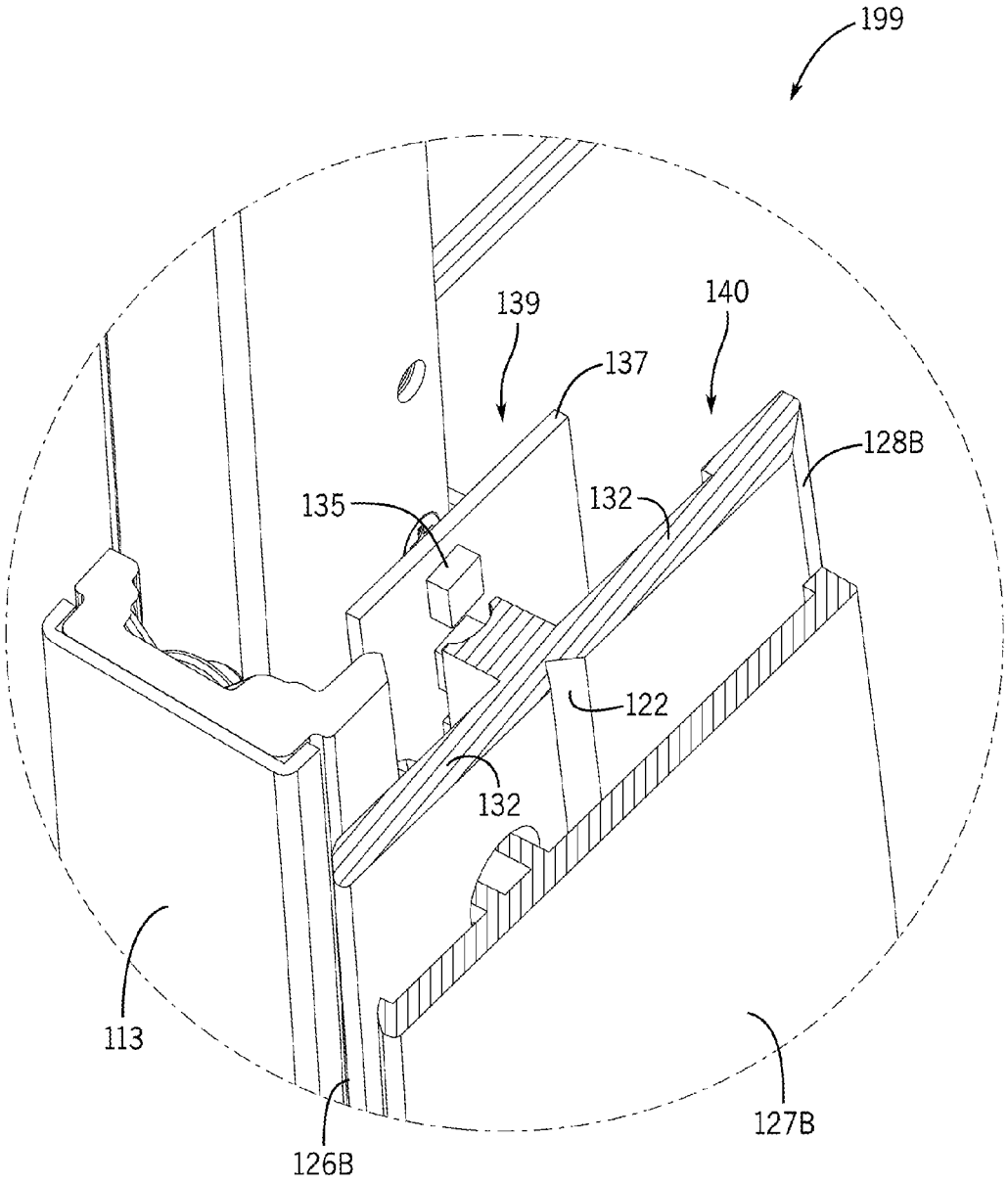
FIG. 4C is an expanded view of the exposed section of a portion of the gaming system of FIG. 4B according to an embodiment of the present invention

Referring to FIG. 4C, an enlarged view of exposed section 199 is shown. The exposed view 199 shows some of the internal structure of the gaming machine 101 and positioning of the cabinet frame 113, the light source 139, the light pipe 140, the light pipe cover 127, the front light pipe exposure zone 126B, and the rear light pipe exposure zone 128B relative to each other. Light from the light source 139 enters the light pipe 140 through a light-entry surface of the stem adjacent to the light source 139, and travels through the stem undergoing total internal reflection. The light is split and reflected by the internal faces of the groove 122 of the light pipe 140, travels through the light pipe arms 132, and exits the light pipe 140 from the front light pipe exposure zone 126B and the rear light pipe exposure zone 128B. The cover 127 shields the majority of the light pipe 140 and the light source 139 from view from the exterior of the gaming machine 100, and may additionally provide structure to improve and maintain total internal reflection of light within light pipe 140. In one embodiment, the light emitted from the front light pipe exposure zone 126 is directly projected toward the player position. The light emitted from the rear light pipe exposure zone 128 "splashes" against the recessed curved portion 125 and creates a washed lighting effect against this surface.

Figure 5A:
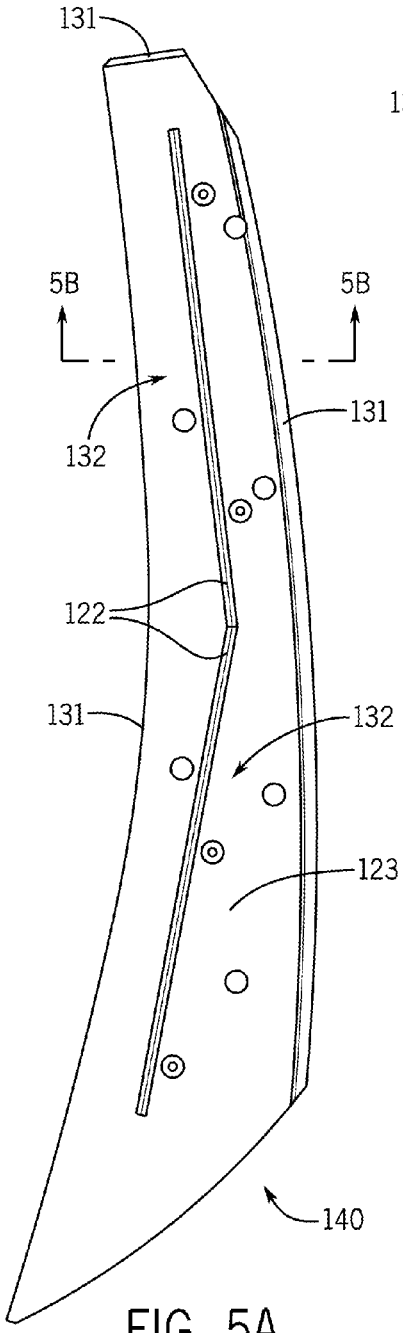
FIG. 5A is a top down view of a light splitting light pipe according to an embodiment of the present invention.

Referring to FIG. 5A, a light pipe 140 is shown, having a groove 122 and a surface 123. In this view, the left edge of the light pipe 140 would be installed in the gaming machine 100 facing the player position. The groove 122 runs generally the length of the light pipe 140 and is configured as two separate, linear sections. The groove 122 extends into the surface 123 and serves to split and reflect light to the set of arms 132 through which the light travels when propagating to the beveled edges 131. The edges 131 are analogous to the front and rear light exposure zones. The light pipe 140 also has a stem 124 which can be seen in cross sectional views (e.g., FIG. 5B), having a light entry surface 134. The light entry surface may be flat or curved. A concave, curved light entry surface, such as the light-entry surface 134 enables more of the light emanating from a light source 139 to enter the stem 124 of the light pipe 140. A curved light entry surface 134 is generally positioned such that light from light source 139 strikes and enters light entry surface 134 orthogonally. The light entry surface 134 of the stem 124 is positioned with respect to a light source 139 to enable as much light as possible projected from the light source 139 to enter the stem 124 and travel through the stem 124 to the groove 122. The groove 122 serves to split the light travelling through the stem 124 to travel through the light pipe 140 via the arms 132.

Figure 5B:
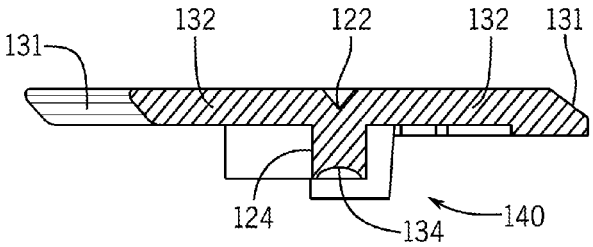
FIG. 5B is a cross section across line 5B-5B of a substantially planar light splitting light pipe according to an embodiment of the present invention.
Figure 5C:
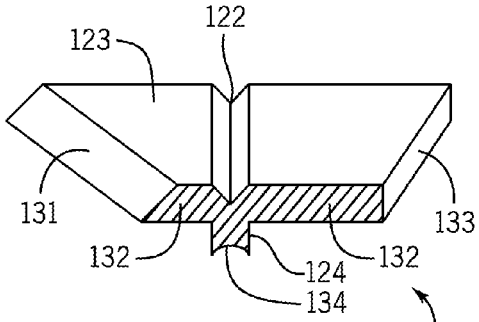
FIG. 5C is a view of a flat light splitting light pipe according to an embodiment of the present invention.
Figure 5D:
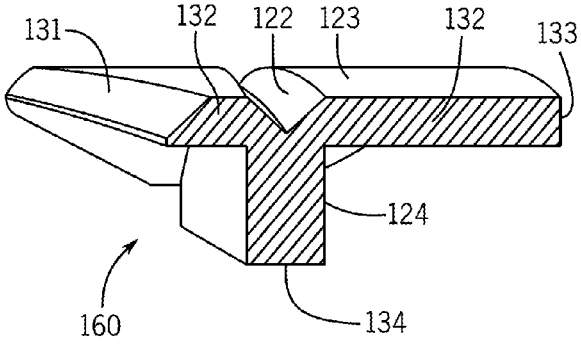
FIG. 5D is a view of a curved light splitting light pipe according to an embodiment of the present invention.

The light source 139 is concealed within the cabinet frame 113. According to one example, the light source 139 includes one or more light-emitting diodes (LEDs) 135 that are mounted on a printed circuit board (PCB) 137. The PCB 137 may be inserted into a receiving slot internally located within the cabinet frame 113 such that the LEDs 135 align with the light entry surface 134 of the light pipe stem 124. Alternatively, the light source 139 may be directly mounted to an internal surface of the cabinet 111. The stem 124 may include a curved or flat light entry surface 134. The light entry surface 134 may be flat and positioned substantially at right angles to the sides of stem 124 as shown in FIG. 5D, or may have a concave, curved surface to accommodate the LEDs 135 of the light source 139, as shown in FIGS. 5B and 5C. Light from light source 139 is directed to stem 124 in order to capture as much light as possible from the light source 139 and internally reflect the light through the stem 124 (minus some minor loss of light at the light entry surface 134). When suitably aligned, the light source 139 causes light to travel through the light pipe stem 124 to the interior surfaces of the groove 122 inside light pipe 140 with minimum loss.

The groove 122 is a notched area acting as a dividing reflector for light which has entered the light stem 124, redirecting portions of the light through arms 132. Typically, the groove 122 is a "v-groove", having angled walls of 45° measured relative to the surface of the light entry surface of the light stem 124, although larger and smaller angles may also be utilized. The resulting interior angle of groove 122 is often kept "sharp" to facilitate distribution of light to both sides of the light pipe 140. Light rays which enter the light stem 124 will strike one of the interior angled walls of the groove 122, and the light will undergo internal reflection within the arms 132 of the light pipe 140. This permits a single light source 139 to simultaneously project light through both arms 132.

The groove 122 may also be sectional, as shown in FIG. 5A, having distinct sections which may receive light from one or more distinct light sources 139. FIG. 5A shows a groove 122 having two sections extending along the length of the light pipe 140, thereby delivering light generally to the entirety of the light pipe 140 and serving to project light from three beveled edges 131 of the light pipe 140. In at least one embodiment, the shape of the light pipe 140 and the positioning of the one or more light sources enables all edges of the light pipe 140 to radiate light.

The finish of the surfaces and edges where light may exit the light pipe material play a large role in the overall amount of light which escapes the light pipe, and the overall resulting appearance of any projected light. When using an edge having a smooth or glossy finish, internal reflection may occur, causing a reduction in the amount of light which exits the light pipe in that region. However, using an edge having a frosted or matte finish reduces internal reflection and increases the light emitted from these regions. Thus, smooth surfaces of the light pipe material are used in regions where light is intended to stay (i.e., maintain internal reflection, e.g., groove 122, surface 123, the walls and surface of stem 124, arms 132, etc.), and a rough surface is used in regions where light is intended to exit the light pipe material (e.g., beveled edge 131, flat edge 133, etc.).

Other embodiments include the use of frosted or smooth finishes on edges 131, 133 which provide a great deal of flexibility for exiting light to be projected from the light pipe 140 at the edges where light is emitted. Various visual effects and manipulation of emitted light may be achieved by altering the finish (i.e., smoothness) of edges and surfaces which are exposed. Another embodiment includes a smoothing, rounding, or chamfering of the "sharp" corner of the groove 122 and the surface (i.e., surface 123) on which it is formed. Adding a radius to the corner of the light splitting groove 122 where it meets the walls of the light pipe arms 132 increases efficiency by directing more light rays projected in a range of critical angles, maximizing total internal reflection from light broadcast from light source 139. The choice of radius or curvature may depend on the specific geometry of the light pipe 140, light source 139 positioning (offset and rotation), and other factors.

In one embodiment, the light pipe 140 may additionally include an acrylic material having diffusing particles, which are helpful in providing a "softer" lighting ambience, e.g., lighting with no light glare and/or hot spots. For example, the acrylic material can be in the form of a sheet, rod, or tube as manufactured by Evonik Industries in the form of ACRYLITE® products. The ACRYLITE® products include products having a clear surface, a frosted surface, pigment formulation yielding 10-19% light transmittance, even distribution of light across an entire surface, etc.

Two different versions of light pipe 140 are shown in FIG. 5C-5D. Referring to FIG. 5C, the light pipe 150 may be fabricated having a flat surface 123 opposite the stem 124. In this embodiment, a linear groove 122 is located in the flat surface 123, remaining straight and parallel to the flat surface 123 and the light stem 124. Alternatively, referring to FIG. 5D, the light pipe 160 may be fabricated having a curved surface 123 opposite the stem 124.

The flat surface 123 has a curved groove 122 situated within. The curved groove 122 remains substantially parallel to the linear light stem 124 and follows the surface 123 of light pipe 160 uniformly; this is generally irrespective of whether the light pipe is flat or curved. Even though the light pipe 160 has a curved surface 123, the mechanics of the light pipe 160 are essentially identical to light pipe 140 and light pipe 150. In general, the curved groove 122 is of uniform depth in regard to the surface 123. The groove 122 generally remains aligned with the LEDs 135 of light source 139, and will function as intended and described provided the groove 122 is positioned to reflect light to at least one arm 132. In general, while the groove 122 remains substantially linear (i.e., not twisted or askew) relative to the light source 139 and conforms to the same shape of the surface 123, the light pipe 160 will continue to enable a single light source 139 to provide light to both arms 132 via the stem 124 and enable propagation and projection from both edges 131 and 133.

In other embodiments, the light source 139 and/or singularly identifiable LED elements 135 may be purposefully non-aligned with the stem 124 and/or the groove 122. The distribution and introduction of light to the stem 124, delivery of light to the groove 122, and propagation of light through the arms 132 and edges 131, 133, all impact the resulting lighting effected by light pipes 140, 150, 160.

Figure 5E:
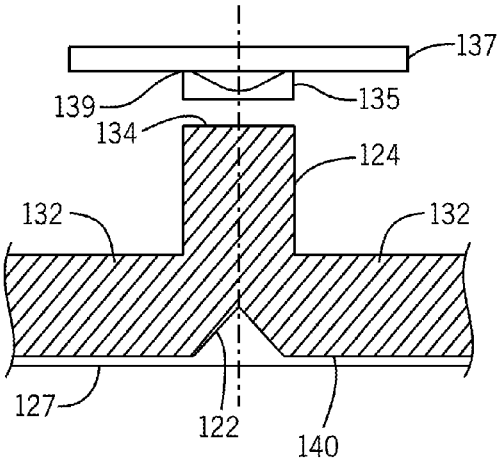
FIGS. 5E, 5F, and 5G are cross sectional views of a light splitting light pipe having differing alignments with a single light source according to differing embodiments of the present invention.

FIG. 5E shows a cross section of the light source 139 and PCB 137 and their position with respect to the centerline of the light pipe stem 124. The light pipe cover 127 shields the face of the light pipe 140 from exterior view. The centerline of the PCB 137 and LEDs 135 match the centerline of the light pipe stem 124 precisely. This tends to maximize the reflection and splitting of light uniformly to both sides of the light pipe 140. The light projecting from LEDs 135 is emitted directly to light entry surface 134, and propagates through the light stem 124 to the groove 122 where splitting and reflection of the light occurs in a uniform and substantially equal distribution.

While light entry surface 134 is depicted as flat, a curved light entry surface 134 may also be implemented, providing a "nesting" place for the lighting element(s). The depictions of the arrangements of light source 139, light entry surface 134, and light pipe 140 in FIG. 5E-5J exemplify differing methods and configurations for light delivery to and through light pipe 140, and should not be held to be specifically limiting. A wide variety of configuration variations are well within the spirit and scope of the invention as disclosed, and none of these configurations as depicted or detailed should considered specifically limiting to the invention at large.

Figure 5F:
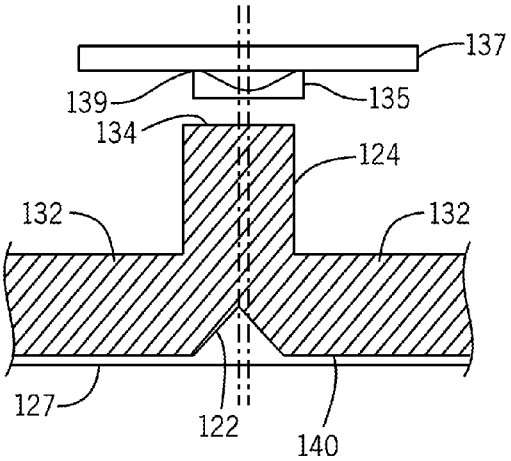

FIG. 5F shows a cross section of the light source 139 and the PCB 137 in which the centerline of the LEDs 135 is offset from the centerline of the light pipe stem 124. Because the interior surfaces of the groove 122 reflect light equally when the light source 139 is positioned parallel to the center of the groove 122, it is possible to modify the amount of light being projected to each arm of the light pipe by modifying the positioning of the light source 139 in relation to the groove 122. The centerline of the PCB 137 and LEDs 135 may be displaced from the centerline of the light pipe stem 124 a given amount to control the amount of light each arm 132 of light pipe 140 will receive after splitting and reflection by groove 122. When compared to FIG. 5E, it is noted the same amount of light projecting from LEDs 135 is exposed to light entry surface 134 and the same amount of light propagates through the light stem 124 to the groove 122. However, the displacement of the light source 139 in relation to the faces of the groove 122 causes splitting and reflection of the light to become unequal and reflect into arms 132 differently on each side of the groove 122. The different amounts of light being propagated through the different arms 132 is useful to provide different levels of light and varied light distribution upon exit from the light pipe 140.

Figure 5G:
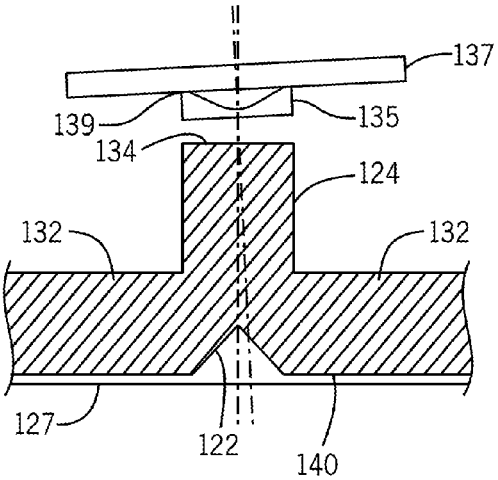

FIG. 5G shows a cross section of the light source 139 and PCB 137 which is purposefully positioned at an offset angle relative to the light entry face 134 of the light pipe stem 124 as well as groove 122. This is another way to control the amount of light which is exposed to each side of the groove 122 and resultantly control the amount of light passing through arms 132.

Figure 5H:
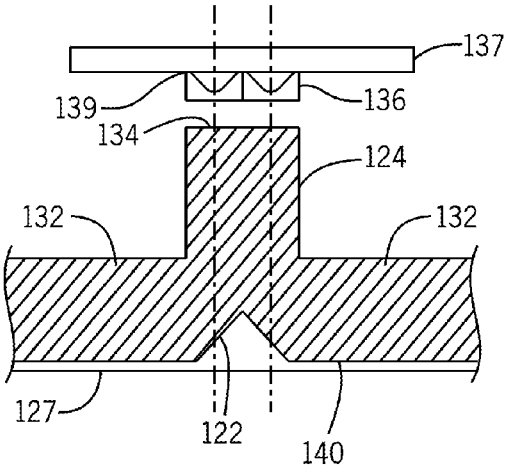
FIGS. 5H, 5I, and 5J are cross sectional views of a light splitting light pipe having differing alignments with dual light sources according to differing embodiments of the present invention.

In another embodiment, FIG. 5H implements a light source 139 which has a set of dual component LEDs 136 comprising two linear sets of LED lights. The set of dual component LEDs 136 may be positioned side by side or staggered on a single PCB 137 as part of a uniform width light source 139, or on differing PCBs placed side by side creating a unified or distinctly separated light source 139. This embodiment provides independent control of lighting to both arms 132 of the light pipe 140, including light color and amount. For example, different color LED components may be used for each side of the light pipe 140 to produce different colored light at each respective light-emitting edge at the end of each arm 132. Another benefit of this embodiment is a significant increase in robustness when the light source 139 and/or the light source LED components 136 are manufactured having misaligned, improperly positioned, or inadvertently rotated components.

Figure 5I:
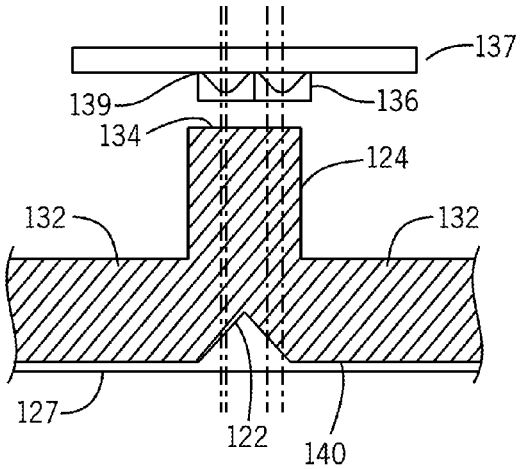

One such example is shown in FIG. 5I, where the center of each of the light source LED components 136 are not as precisely positioned as the light source LED components 136 shown in FIG. 5H. While the light source LED components 136 in FIG. 5H are fully aligned with the center of the faces of the groove 122 of light pipe 140, the light source LED components 136 in FIG. 5I are positioned off center to the faces of the groove 122. This may be a result of manufacturing variances in the housing, mounting surface, or mounting technique which physically secures the light source 139, or perhaps a manufacturing variance of positioning of the light source LED components 136 themselves on the PCB 137.

Figure 5J:
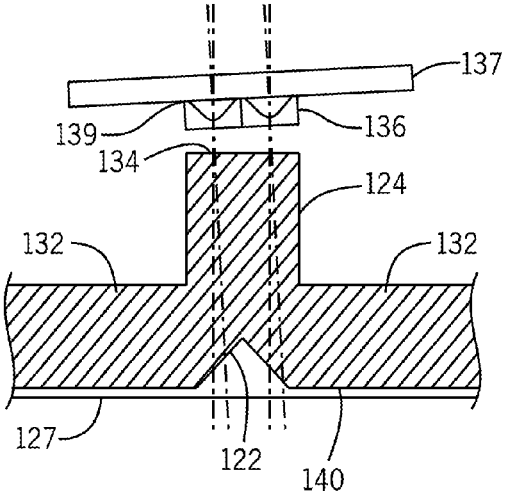

FIG. 5J shows a manufacturing misalignment of the mounting for the light source 139. An alignment of this type may also be a result of improper or imprecise manufacturing when securing the light source LED components 136 to the PCB 137 of light source 139. Alternatively, a configuration of this type may be chosen by a designer to compensate for certain types of LED components 136 or other types of lighting not having a uniform projection. This particular embodiment provides a higher level of tolerance for components having manufacturing aberrations which may affect the resulting lighting when using the light pipes as described.

In addition to a single component light pipe 140, 150, 160, having a light stem and groove to deliver and split light, it is possible to use an external reflective mirror to illuminate two distinct light pipes by splitting light projected from one or more light sources arranged, for example, in a linear, sectional fashion.

Figure 6:
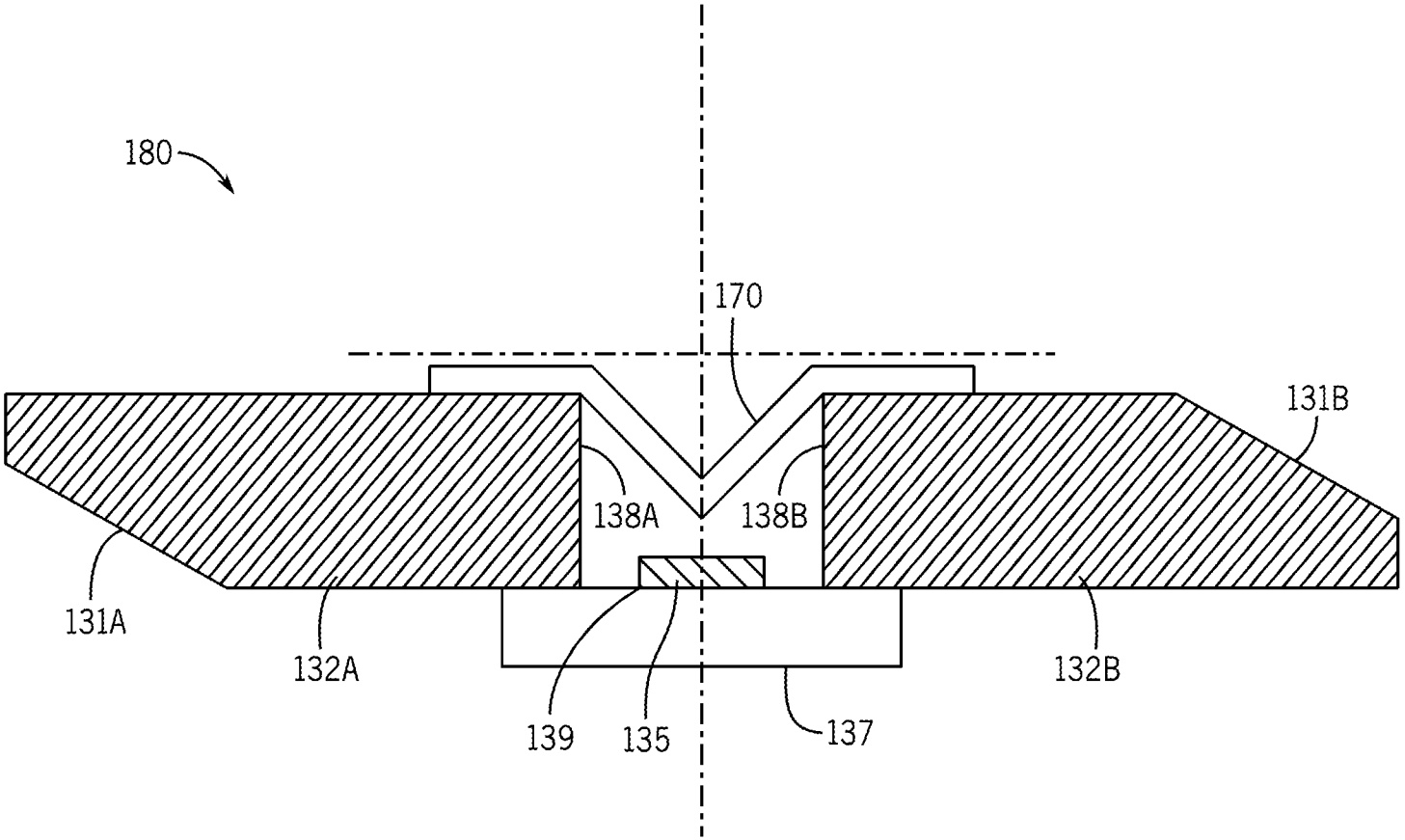
FIG. 6 is a cross section of a two part light splitting light pipe according to an embodiment of the present invention.

Another embodiment is specifically detailed referring to FIG. 6. A light pipe assembly 180 includes a set of light pipe arms having a set of beveled edges. The light pipe arms include a left arm 132A and a right arm 132B, with corresponding beveled edges 131A and 131B. The arms 132A, 132 B also include left light entry surface 138A and right light entry surface 138B. Light source 139 includes one or more LEDs 135 mounted on a PCB 137.

A reflector 170 is provided which reflects light projected from light source 139 through light pipe arms 132A, 132B. The reflector 170 may be manufactured from metal or any other material which is highly reflective. In one embodiment, the reflector 170 has angled walls measuring 45° relative to the central projection axis of light source 139, but variations of this angle are within the spirit and scope of the invention as disclosed, and no one configuration should be held as specifically limiting.

Light projected by light source 139 strikes one of the angled walls of the reflector 170 and is redirected to one of arms 132A, 132B. The arms 132A, 132B have substantially flat, smooth light entry surfaces 138A, 138B exposed to the incoming reflected light which maximizes the acceptance of incident light into the arms 132A, 132B of the light pipe 180. Further, the positioning of the reflector 170 and the arms 132A, 132B as shown in FIG. 6 causes light projecting from the light source 139 which misses the reflector 170 to hit the light entry surfaces 138 of the arms 132 instead.

Light which strikes light entry surfaces 138 at an angle that is close to perpendicular are less likely to leave the arms 132 when travelling through arms 132 to the beveled edges 131. That is, when the incoming light from light source 139 is reflected by reflector 170 and strikes the light entry surfaces 138 of the arms 132 within a proper range of angles, a maximum amount of the incoming light undergoes total internal reflection within the arms 132. This minimizes light loss as the light travels through the arms 132 of light pipe 180 to edges 131.

Due to physical restrictions, the point of the reflector 170 is never a perfect sharp point, so some of the light striking the area of the point will be reflected back toward the LED 135 and to the area surrounding the LED 135. Some of this light will be absorbed by the materials of the LED 135 and the surface of the PCB 137 below the LED 135. Using a white reflective PCB solder mask helps to recycle this scattered light and direct it toward the light entry surfaces 138 of the arms 132 as intended.

Similar to FIG. 5A-5G, light pipe assembly 180 enables a single light source 139 to simultaneously project light to two distinct light pipes sections for simultaneous routing and display. In the instant case, both light pipe arms 132 have beveled edges 131, but the use of a beveled edge (e.g., beveled edge 131) and use of a flat edge (e.g., flat edge 133), along with adjoining surfaces may be configured in a number of ways to provide configurations of primary and/or secondary light zones which are within the spirit and scope of the invention as disclosed, and none of these configurations should be held as specifically limiting. Different types of light sources may also be employed, including dual light sources similar to those depicted in FIGS. 5H-5J, enabling control of the color and amount of delivered light to the light pipe edges 131.

Similar to FIG. 5A-5G, light pipe assembly 180 may include other embodiments which do not depart from the overall spirit and scope of the invention. These may include displacement or rotation of the light source 139 in alignment with the reflector 170 such that more light is projected to one side of light pipe assembly 180. That is, linear alignment (i.e., displacement) and angular alignment (i.e., rotation) of the light source 139 and component LEDs 135 may alter the amount of light projected to each side of the reflector 170 by the light source 139. As discussed prior, multiple light sources may be implemented to direct light to a specific reflector or arm 132 of light pipe assembly 180 similar to FIG. 5H-5J. The surfaces of reflector 170 will reflect light equally when the light source 139 is aligned parallel to the center of the reflector 170, within specific tolerances, but may be configured to provide certain kinds and amounts of light to each light emitting edge 131. Duplication and/or rotation of light source 139 and/or LEDs 135 may also be used to alter angular alignment to the reflector 170, as long as sufficient light delivery to the reflector 170 is maintained for the desired lighting effects where the light exits the light pipes. All of these variations are considered not to depart from the overall spirit and scope of the invention.

Also, the selective use of frosted or smooth finishes on any and all edges and faces, and variation of materials, shape, and surface treatment(s) available for various portions of light pipe assembly 180 and any equipment in which light pipe assembly 180 is mounted, provides a great deal of flexibility for manipulating light and creating various visual effects using the disclosed invention without departing from the overall spirit and scope of the invention.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming machine comprising:

a cabinet including a cabinet frame facing a player position in front of the gaming machine;

a display device positioned within the cabinet and configured to display a wagering game;

one or more light sources; and a light pipe structure along the cabinet frame and including a dividing reflector and first and second arms extending from the dividing reflector, the dividing reflector configured to receive light projected by the one or more light sources, direct a first portion of the light through the first arm, and direct a second portion of the light through the second arm.

2. The gaming machine of claim 1, wherein the first arm propagates the first portion of the light to an edge of the first arm, wherein the first arm is positioned with the edge facing the player position, and wherein the second arm is positioned to be concealed from being viewed from the player position and to project the second portion of the light onto an exterior surface of the cabinet frame, the exterior surface facing the player position.

3. The machine of claim 1, wherein the dividing reflector and the first and second arms are constructed from a single piece of material.

4. The machine of claim 1, wherein the dividing reflector is constructed from a piece of material independent from the first and second arms.

5. The machine of claim 1, wherein the light pipe structure includes a stem configured to receive the light projected by the one or more light sources and to transmit the light to the dividing reflector.

6. The machine of claim 1, wherein the dividing reflector includes first and second angled walls forming a V-shaped configuration, the first angled wall directing the first portion of the light through the first arm, the second angled wall directing the second portion of the light through the second arm.

7. The machine of claim 6, wherein the one or more light sources include a first light source and a second light source, the first light source generating the first portion of the light, the second light source generating the second portion of the light.

8. The machine of claim 1, wherein the dividing reflector is configured to split the light into the first and second portions.

9. A lighting arrangement for a gaming machine, the gaming machine including a cabinet and a display device, the cabinet including a cabinet frame facing a player position in front of the gaming machine, the display device being positioned within the cabinet and configured to display a wagering game, the lighting arrangement comprising:

one or more light sources; and a light pipe structure along the cabinet frame and including a dividing reflector and first and second arms extending from the dividing reflector, the dividing reflector configured to receive light projected by the one or more light sources, direct a first portion of the light through the first arm, and direct a second portion of the light through the second arm.

10. The lighting arrangement of claim 9, wherein the first arm propagates the first portion of the light to an edge of the first arm, the second arm propagates the second portion of the light to an edge of the second arm, and the second arm is positioned to be concealed from being viewed from the player position and the edge of the second arm is positioned to project the second portion of the light onto an exterior surface of the cabinet frame.

11. The lighting arrangement of claim 10, wherein the first arm is positioned with the edge hieing the player position, and wherein the exterior surface is positioned facing the player position.

12. The lighting arrangement of claim 9, wherein the light pipe structure includes a stem configured to receive the light projected by the one or more light sources and to transmit the light to the dividing reflector.

13. The lighting arrangement of claim 9, wherein the dividing reflector includes first and second angled walls forming a V-shaped configuration, the first angled wall directing the first portion of the light through the first arm, the second angled wall directing the second portion of the light through the second arm.

14. The lighting arrangement of claim 9, wherein the one or more light sources include a first light source and a second light source, the first light source generating the first portion of the light, the second light source generating the second portion of the light.

15. The lighting arrangement of claim 9, wherein the dividing reflector is configured to split the light into the first and second portions.

16. A method of operating a gaming machine, the gaming machine including a cabinet, a display device, and a light pipe structure, the cabinet including a cabinet frame facing a player position in front of the gaming machine, the display device being positioned within the cabinet and configured to display a wagering game, the light pipe structure being positioned along the cabinet frame and including a dividing reflector and first and second arms extending from the dividing reflector, the method comprising:

projecting light from one or more light sources onto the dividing reflector; and directing, by the dividing reflector, a first portion of the light through the first arm and a second portion of the light through the second arm.

17. The method of claim 16, further comprising the steps of:

propagating, by the first arm, the first portion of the light to an edge of the first arm;

propagating, by the second arm, the second portion of the light to an edge of the second arm; and projecting, by the edge of the second arm, the second portion of the light onto an exterior surface of the cabinet frame.

18. The method of claim 17, wherein the first arm is positioned with the edge facing the player position, the exterior surface is positioned facing the player position, and the second arm is positioned to be concealed from being viewed from the player position.

19. The method of claim 16, further comprising the step of receiving, by a stem of the light pipe structure, the light projected by the one or more light sources and transmitting the light to the dividing reflector.

20. The method of claim 16, wherein the dividing reflector includes first and second angled walls forming a V-shaped configuration, wherein the first angled wall directs the first portion of the light through the first arm and the second angled wall directs the second portion of the light through the second arm.

21. The method of claim 16, wherein the one or more light sources include a first light source and a second light source, the first and second portions originating from the respective first and second light sources; and wherein the projecting includes projecting light from the first light source onto a first side of the dividing reflector and light from the second light source onto a second side of the dividing reflector.

22. A gaming machine comprising:

a cabinet including a cabinet frame facing a player position in front of the gaming machine, and one or more internally positioned light sources providing light not viewable from the player position;

one or more display devices within the cabinet frame displaying a wagering game; and at least one light pipe comprising a light splitter-reflector positioned to provide a first portion of the light to a first emitting surface via a first pipe section, and a second portion of the light to a second emitting surface via a second pipe section.

23. The gaming machine of claim 22, wherein the light splitter-reflector is a separate component from the at least one light pipe.

24. The gaming machine of claim 22, wherein the first pipe section and the second pipe section are conjoined at a stem of the at least one light pipe, the light splitter-reflector is a groove positioned parallel to the stem of the at least one light pipe such that a first surface of the groove reflects the first portion of the initial light and a second surface of the groove reflects the second portion of the initial light.

25. The gaming machine of claim 22, wherein a first set of the one or more light sources generates the first portion of the initial light and a second set of the one or more light sources generates the second portion of the initial light.

26. The gaming machine of claim 22, wherein the light splitter-reflector is linear.

27. The gaming machine of claim 22, wherein the light splitter-reflector is curved.

28. A method for implementing one or more lighting sources to illuminate a plurality of regions of a gaming machine, the method comprising:

providing an initial light from at least one of the one or more lighting sources;

splitting and reflecting the initial light towards a plurality of light pipes; and receiving a portion of the initial light at each of the plurality of light pipes, wherein each of the plurality of light pipes illuminates at least one region of the gaming machine visible to the player of the gaming machine.

29. The method for illuminating a plurality of regions of a gaming machine set forth in claim 28, the method further comprising splitting and reflecting the initial light such that differing portions of the initial light travel through and exit the plurality of light pipes in opposite directions.

30. The method for illuminating a plurality of regions of a gaming machine set forth in claim 28, wherein a first set of the one or more lighting sources illuminates a first region of the gaming machine and a second set of the one or more lighting sources illuminates a second region of the gaming machine.

* * * * *